US006215381B1

(12) United States Patent
Aoki

(10) Patent No.: US 6,215,381 B1
(45) Date of Patent: Apr. 10, 2001

(54) MAGNETIC LOCK DEVICE

(75) Inventor: Yoshihiro Aoki, Tokyo (JP)

(73) Assignee: Application Art Laboratories Co., Ltd., Tokyo (JP)

( * ) Notice: Subject to any disclaimer, the term of this patent is extended or adjusted under 35 U.S.C. 154(b) by 0 days.

(21) Appl. No.: 09/474,017

(22) Filed: Dec. 28, 1999

(30) Foreign Application Priority Data

Dec. 28, 1998 (JP) ..... 10-374343

(51) Int. Cl.[7] ..... H01H 9/00

(52) U.S. Cl. ..... 335/207; 24/303; 292/251.5

(58) Field of Search ..... 335/205–207, 335/302–306; 24/303; 292/251.5

(56) References Cited

U.S. PATENT DOCUMENTS 3,924,631 * 12/1975 Mancusi, Jr. ..... 128/1 R
5,887,917 * 3/1999 Luciana ..... 292/251.5
5,983,464 * 11/1999 Bauer ..... 24/303
5,987,715 * 11/1999 Khon ..... 24/303

* cited by examiner

*Primary Examiner*—Lincoln Donovan
*Assistant Examiner*—Tuyen Nguyen
(74) *Attorney, Agent, or Firm*—Wenderoth, Lind & Ponack, L.L.P.

(57) ABSTRACT

A magnetic lock device includes a first element and a second element that are capable of being detachably coupled together by attracting each other magnetically under the magnetic interaction of permanent magnets, wherein each of the first and second elements includes an annular permanent magnet having a center bore through it, a ferromagnetic disk-like plate disposed to make contact with the permanent magnet, and a ferromagnetic projecting member extending from the disk-like plate and through the center bore of the permanent magnet. All of the component parts for the first and second elements are covered with any suitable synthetic resin film, sheet or the like and shielded from the outside, so that any foreign matter such as dust, particularly ferromagnetic particles like iron, cannot enter the gap or space that is present between the outer peripheral wall of the projecting member and the inner peripheral wall of the center bore through the annular permanent magnet. In one specific form of the magnetic lock device, each of the first and second elements is entirely covered with any suitable non-magnetic, synthetic resin film, sheet, covering or casing, or is entirely covered with a coating of any suitable non-magnetic, synthetic resin layer. In another specific form, each of the first and second elements is covered with any suitable non-magnetic, synthetic resin film, sheet, covering or casing, or is covered with a coating of any suitable non-magnetic, synthetic resin layer, except for the ends of the ferromagnetic projecting members in the first and second elements engaging each other that remain uncovered or exposed. In both forms, each of the first and second elements includes an annular permanent magnet, wherein one annular permanent magnet has a given polarity (S or N) opposed to the polarity (N or S) of the other annular permanent magnet on the side on which the first and second elements are to engage each other.

2 Claims, 8 Drawing Sheets

MAGNETIC LOCK DEVICE

FIELD OF THE INVENTION

The present invention relates to a magnetic lock device including two separate elements that arc capable of being detachably coupled together by attracting each other magnetically under the magnetic interaction of two permanent magnets, and more particularly to a magnetic lock device that may be used with an article, such as bags, that usually includes two integral parts, such as a flap and a body, for detachably coupling those two parts together, and may also be used with clothing or clothes that usually require the regular or frequent washing or cleaning treatment.

DESCRIPTION OF THE PRIOR ART

In the prior art, there is a conventional magnetic lock device that takes advantage of the magnetic attracting action of a permanent magnet, and is used with an article such as a bag, for example, for detachably coupling the body and flap of the bag. It is known that this device performs well for the above purpose. The conventional magnetic lock device is known in different types and constructions. Typically and basically, it has the construction that is described below.

The magnetic lock device essentially includes a first element and a second element that are capable of being detachably coupled together by utilizing the magnetic interaction between a permanent magnets and a ferromagnetic plate. Specifically, for one part, the first element includes an annular permanent magnet having a center bore through it, and a first ferromagnetic disk-like plate disposed to make contact with the non-attracting side of the annular permanent magnet that is located on the side opposite the attracting side of the magnet, and a first ferromagnetic projecting member extending from the center of the first ferromagnetic disk-like plate and through the said center bore of the permanent magnet toward the attracting side of the annular permanent magnet. The annular permanent magnet and the first ferromagnetic disk-like plate having the first ferromagnetic projecting member are packaged as a single unit within a non-magnetic covering. The first element thus formed acts as the attracting unit.

For the other part, the second clement, which acts as the unit to be attracted by the first element or attracting unit, includes a second ferromagnetic disk-like plate that is to be attached to the attracting side of the annular permanent magnet of the first element. As the annular permanent magnet and the first ferromagnetic disk-like plate comprising the first element arc packaged by the non-magnetic covering, when the second ferromagnetic disk-like plate of the second element is attached to the attracting side of the annular permanent magnet of the first element by and under the magnetic force of the annular permanent magnet, the upper horizontal part of the non-magnetic covering, which covers the attracting side of the annular permanent magnet, is sandwiched between the second ferromagnetic disk-like plate and the annular permanent magnet.

The second ferromagnetic disk-like plate of the second element can be attached to the annular permanent magnet of the first clement by and under the magnetic force of the annular permanent magnet, also the second ferromagnetic disk-like plate can be detached from the annular permanent against the magnetic force of the annular permanent magnet.

The second ferromagnetic disk-like plate of the second element has a second ferromagnetic projecting member which extends from the center of the second ferromagnetic disk-like plate, and, when the second ferromagnetic disk-like plate of the second element is attached to the annular permanent magnet of the first element, extends through the center bore of the annular permanent magnet toward the first ferromagnetic disk-like plate of the first element.

The second ferromagnetic projecting member on the second element can engage the first ferromagnetic projecting member on the first ferromagnetic disk-like plate through the center bore of the permanent magnet when the second ferromagnetic disk-like plate is attached to the annular permanent magnet. Thus, the first and second elements may be coupled together magnetically under the action of the permanent magnet, which is enclosed in the first element, as they are brought closer to each other, so that a magnetic circuit can be concluded through the first and second ferromagnetic projecting members, the first and second ferromagnetic disk-like plates, and the annular permanent magnet. This permits the first and second elements to be coupled securely.

When the first and second elements are to be detached, this may be accomplished simply by moving them laterally relative to each other with a certain angle with regard to the interface between the first and second elements as coupled, and thus disconnecting the path of the magnetic circuit principally formed by the first and second ferromagnetic projecting members.

This device is of a compact size, and provides powerful magnetic attracting force that can keep them locked securely. Attaching and detaching the two elements may be accomplished very easily. The magnetic lock device described above is disclosed in Japanese patent application No. H2 (1990)-205503, for example.

It should be noted, however, that according to the conventional magnetic lock device described above, there is a gap between the outer peripheral wall of the first ferromagnetic projecting member and the inner peripheral wall of the center bore of the permanent magnet. The space formed by the gap may easily introduce particles such as dust, particularly ferromagnetic particles like iron. Those ferromagnetic particles may create a short magnetic circuit between the inner peripheral wall of the center bore of the permanent magnet and the outer peripheral wall of the first ferromagnetic projecting member. When this situation occurs, the magnetic circuit formed by the first and second ferromagnetic projecting members, the first and second ferromagnetic plates and the permanent magnet may become weaker, which may reduce the magnetic interaction between the first and second elements when they are coupled. Therefore, in the conventional magnetic lock device as before described, it is necessary to take care that any particle can not enter into the gap between the inner peripheral wall of the center bore of the annular permanent magnet and the outer peripheral wall of the first ferromagnetic projecting member.

But when the conventional magnetic lock device is used with clothing or clothes that may usually require the regular or frequent washing or cleaning treatment or that may often be put on the ground or make contact with other various objects, it is likely that particles such as dust, particularly ferromagnetic particles like iron, will enter the gap or space between the inner peripheral wall of the center bore of the permanent magnet and the outer peripheral wall of the first ferromagnetic projecting member. For this reason, the conventional magnetic lock device has principally been used with bags, rather than clothing or clothes.

It should also be noted that the conventional magnetic lock device includes the first and second ferromagnetic plates that are made of iron that may easily gather rust when exposed to water or moisture. This is another reason why the conventional device has not been used with the clothing or clothes.

SUMMARY OF THE INVENTION

The present invention provides a new magnetic lock device which can eliminate the problems associated with the conventional magnetic lock device as described above. According to the present invention, a magnetic lock device includes a first element and a second element that are capable of being detachably coupled, and each of the first and second elements has an annular permanent magnet enclosed therein such that one permanent magnet and the other permanent magnet have the opposed polarities on the side facing opposite each other, wherein each of the first and second elements may entirely be covered with any suitable non-magnetic, synthetic resin film, sheet, covering and casing or may entirely have a coating of the non-magnetic, synthetic resin layer formed thereon, or alternatively may be covered with any suitable non-magnetic, synthetic resin film, sheet, covering and casing or may have a coating of the nonmagnetic, synthetic resin layer formed thereon, with the ends of the ferromagnetic projecting members engaging each other being uncovered or exposed.

It may be appreciated from the detailed description presented so far that the magnetic lock device according to the particular preferred embodiments and variation thereof has advantages over the conventional magnetic lock device whose usage is limited to bags, in that the magnetic lock device according to the present invention can be used not only with bags, but also with clothes that require regular and frequent washing or cleaning treatment. To provide those advantages, each of the first element and the second element may have an annular permanent magnet enclosed therein such that the permanent magnet and the other permanent magnet have the opposed polarities on the side facing opposite each other. And the first element may totally be covered with the non-magnetic, synthetic resin film, sheet, covering or casing or coated with the non-magnetic, synthetic resin layer. Alternatively, the first element and the second element may be covered with the non-magnetic, synthetic resin film, sheet, covering or casing or coated with the non-magnetic, synthetic resin layer, such that the ends of the first and second ferromagnetic projecting members engaging each other remain uncovered or exposed. Thereby, the gaps or spaces that are present between the inner peripheral wall of the center bore in the annular permanent magnet and the outer peripheral wall of the ferromagnetic projecting member extending through the center bore can be protected against any foreign matter such as dust, particularly magnetic particles like iron, that might otherwise enter the gaps or spaces. All of the metal component parts including the ferromagnetic plates, projecting members, etc. can also be protected against any possible rust that might occur if water or moisture should enter there.

In addition, the magnetic lock device according to the present invention has the advantage in that the first element and the second element can be coupled more securely and more stably by the increased magnetic interaction of the first and second annular permanent magnets of opposed polarities facing each other, coupled with the magnetic circuit formed by the individual ferromagnetic component parts packaged in the respective first and second elements.

DETAILS OF THE PREFERRED EMBODIMENTS

Figure 1:
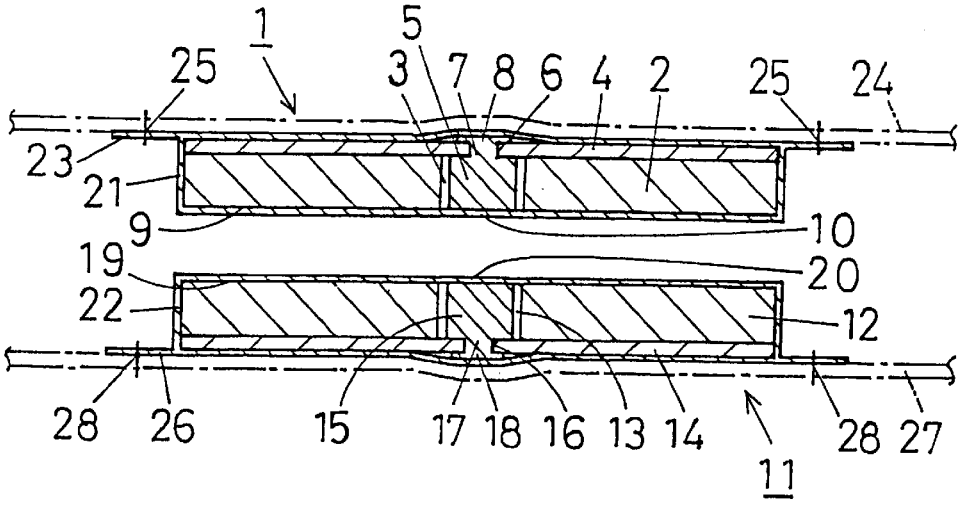
FIG. 1(*a*), FIG. 1(*b*) and FIG. 1(*c*) illustrate a first preferred embodiment of the present invention, in which FIG. 1(*a*) is a cross sectional view of first and second elements that are separated from each other, FIG. 1(*b*) is a cross sectional view of the first and second elements that are coupled, and FIG. 1(*c*) is a plan view of the second element.
Figure 1:
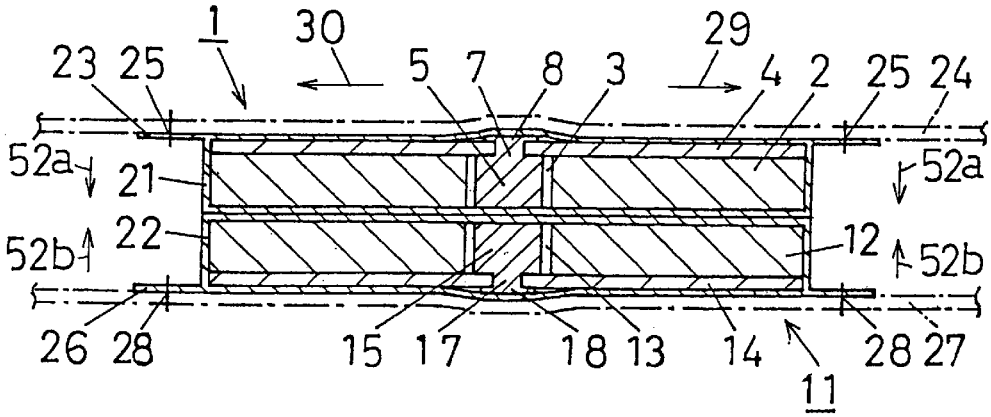
Figure 1:
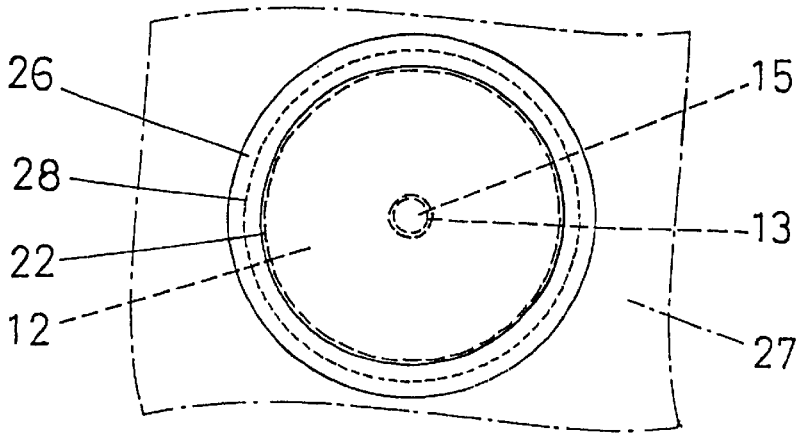

The present invention is now described in further detail with reference to several preferred embodiments shown in the drawings.

Referring first to FIG. 1, the magnetic lock device includes a first element 1 and a second element 11 that are capable of being detachably coupled together by the magnetic action. Specifically, the first element 1 includes a first annular permanent magnet 2 having a center bore 3 through it, a first ferromagnetic disk-like plate 4 that is provided to engage the non-attracting side of the first annular permanent magnet 2, and a first ferromagnetic projecting member 5 extending from the center of the first ferromagnetic disk-like plate 4 through the center bore 3 of the first annular permanent magnet 2 until it reaches the plane flush with the plane on the attracting side 9 of the first annular permanent magnet 2. Those component parts are incorporated as a single unit within a synthetic resin covering 21.

The second element 11 includes a second annular permanent magnet 12 having a center bore 13 through it and disposed to provide the polarity opposite to the polarity of the attracting side 9 of the first annular permanent magnet 2 such that the second and first annular permanent magnets can magnetically attract each other on the sides 19 and 9 thereof facing opposite each other. A second ferromagnetic disk-like plate 14 is disposed to engage the non-attracting side of the second annular permanent magnet 12 opposite the attracting side 19, and a second ferromagnetic projecting member 15 extends from the center of the second ferromagnetic disk-like plate 14 through the center bore 13 of the second annular permanent magnet 12 until it reaches the plane flush with the plane on the attracting side 19 of the second annular permanent magnet 12. These component parts are incorporated as a single unit within a synthetic resin covering 22.

For the first element 1, the gap or space that is present between the outer peripheral wall of the first ferromagnetic projecting member 5 and the inner peripheral wall of the center bore 3 of the annular permanent magnet 2 is shielded from the outside by the synthetic resin covering 21 on the side 10 engaging the corresponding side of the second element 11 so that any foreign matter such as dust, particularly ferromagnetic particles like iron, cannot enter the gap or space.

Similarly, for the second element 11, the gap or space that is present between the outer peripheral wall of the second ferromagnetic projection member 15 and the inner peripheral wall of the center bore 13 of the annular permanent magnet 12 is shielded from the outside by the synthetic resin covering 22 on the side 20 engaging the corresponding said 10 of the first element 1 so that any foreign matter such as dust, particularly ferromagnetic particles like iron, cannot enter the gap or space.

As both the first element 1 and the second element 11 are entirely shielded by the synthetic resin coverings 21, 22, respectively, there is no risk of any water or moisture entering into the elements. As a result, no rust gathers on the metallic component parts inside the elements. Thus, the first and second elements can serve as a fastener for clothing or clothes that usually require the regular or frequent washing or cleaning treatment.

In the example shown in FIG. 1, the first and second ferromagnetic projecting members 5, 15 have an extension 7, 17 on the rear end thereof, respectively, and the first and second ferromagnetic disk-like plates 4, 14 have a center bore 6, 16 through it, respectively. The extensions 7, 17 are passed through the center bores 6, 16, respectively, and the portions 8, 18 of the extensions 7, 17 that project through the center bores 6, 16 may be pressed against the ferromagnetic plates 4, 14, respectively. In this way, the projecting members 5, 15 can be secured to the ferromagnetic plates 4, 14, respectively.

Alternatively, the projecting members 5, 15 may be formed as an integral part of the respective ferromagnetic plates 4, 14.

Alternatively, the ferromagnetic plates may have no center bore. In this case, the projecting members 5, 15 may be secured at the rear ends thereof to the ferromagnetic plates 4, 14, respectively, by means of fusion or bonding.

The synthetic resin covering 21, 22 may be made of any synthetic resin materials that are not magnetized in nature.

The sides of the first and second elements 1 and 11 on which they are to be fastened to the corresponding separate parts 24 and 27 of an article such as clothing or clothes, respectively, may slightly protrude toward the parts 24 and 27 because of the presence of the rear ends 8 and 18 on the first and second ferromagnetic projecting members 5 and 15. To mitigate this effect, the synthetic resin coverings 21 and 22 may be made of any synthetic resin film or sheet that is flexible enough to absorb such protrusion and to permit the first and second elements 1 and 11 to be fastened to the corresponding parts 24 and 27 of the article by sewing threads. For example, this may be accomplished by sewing threads 25, 28 directly into the marginal edges 23, 26 around the periphery of the first and second elements 1, 11 on the side on which the elements are to be fastened to the corresponding parts 24, 27, although this is not shown.

Figure 2:
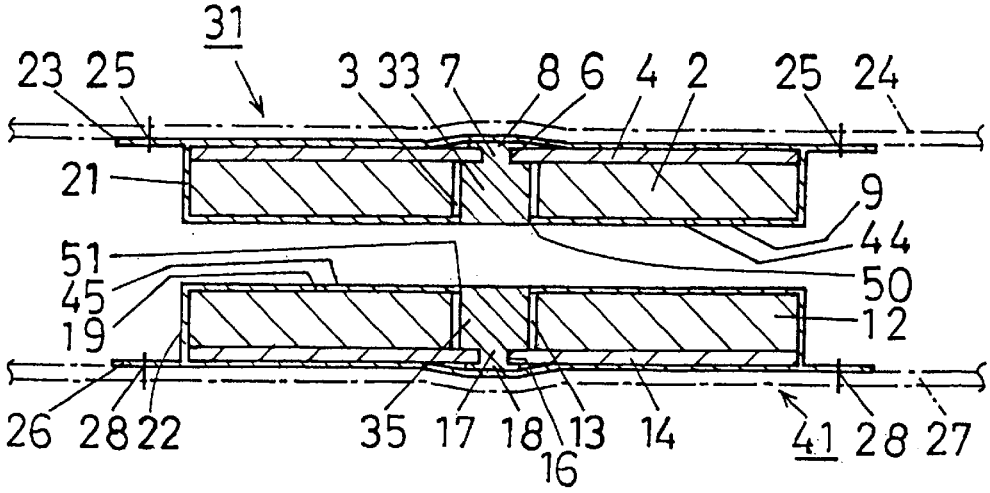
FIG. 2(*a*), FIG. 2(*b*) and FIG. 2(*c*) illustrate second preferred embodiment of the present invention, in which FIG. 2(*a*) is a cross sectional view of first and second elements that are separated from each other, FIG. 2(*b*) is a cross sectional view of the first and second elements that are coupled, and FIG. 2(*c*) is a plan view of the second element.
Figure 2:
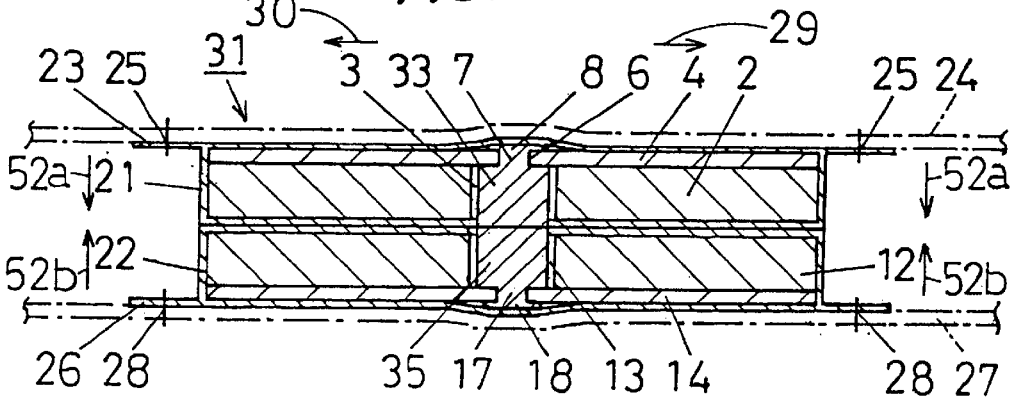
Figure 2:
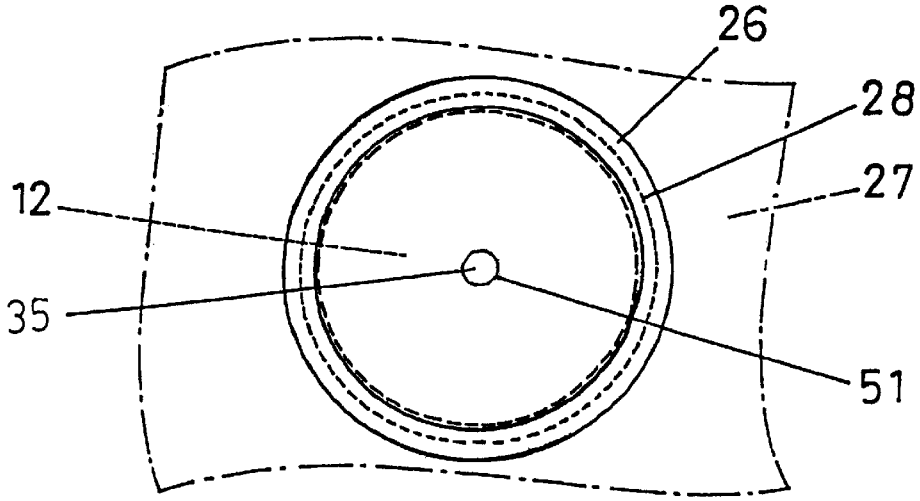
Figure 6:
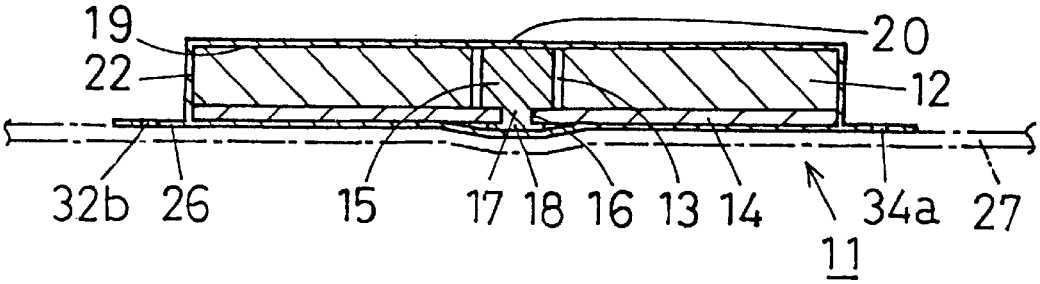
FIG. 6(*a*) and FIG. 6(*b*) illustrate a sixth preferred embodiment of the present invention, in which FIG. 6(*a*) is a cross sectional view of a second element and FIG. 6(*b*) is a plan view of the second element.
Figure 6:
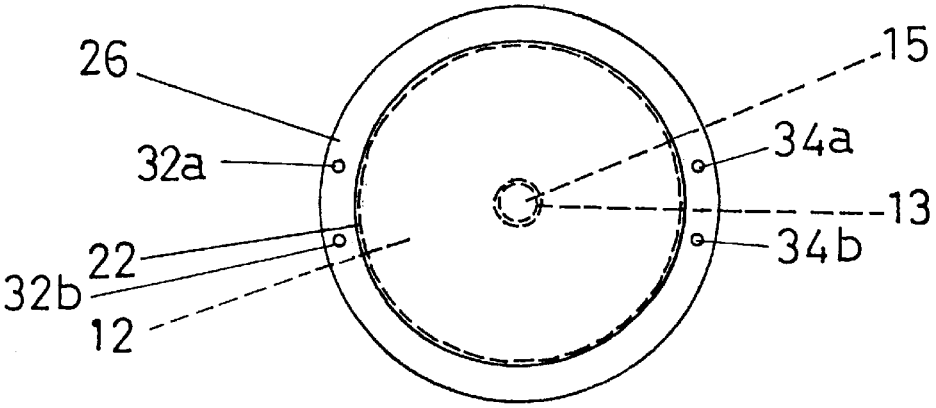
Figure 7:
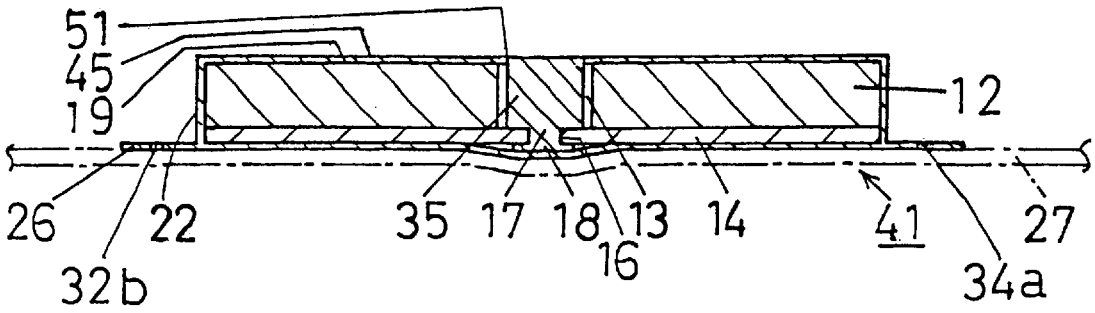
FIG. 7(*a*) and FIG. 7(*b*) illustrate a seventh preferred embodiment of the present invention, in which FIG. 7(*a*) is a cross sectional view of a second element and FIG. 7(*b*) is a plan view of the second element.
Figure 7:
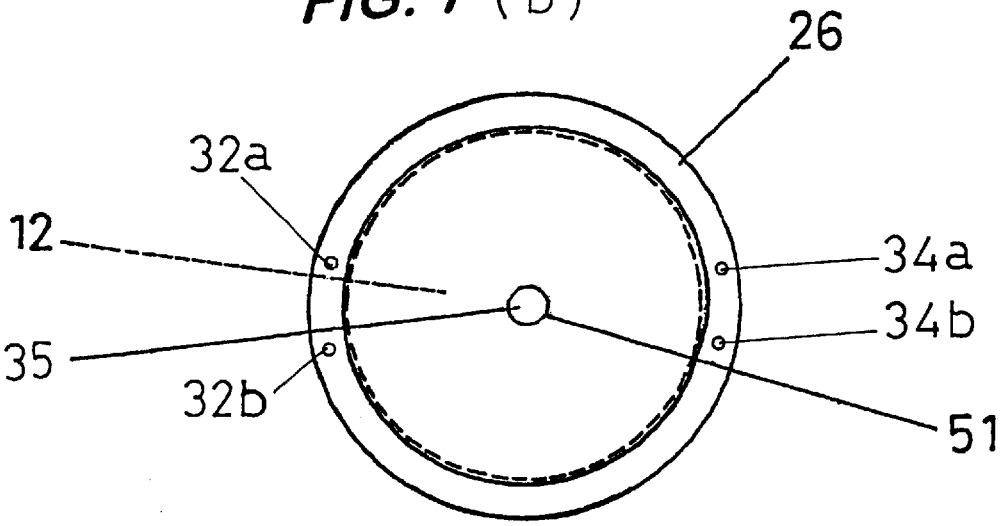

The synthetic resin covering 21, 22 may also be made of any hard or rigid materials that can be formed to accept the protrusion that occurs slightly toward the parts 24, 27 due to the presence of the rear ends 8, 18 on the first and second ferromagnetic projecting members 5, 15 on the respective sides of the first and second elements 1, 11 on which the elements are to be fastened to the corresponding parts 24, 27. In this case, the first and second elements 1, 11 may be fastened to the corresponding parts 24, 27 by providing thread holes 32*a*, 32*b*, 34*a*, 34*b* on the marginal edges 23, 26 around the periphery of the first and second elements 1, 11, respectively, through which threads may be sewn to fasten them to the corresponding parts 24, 27. This is represented in FIGS. 6 and 7. Specifically, the second elements 11, 41 that are shown in FIGS. 1 and 2, respectively, may be varied to have the thread holes 32*a*, 32*b*, 34*a*, 34*b* around the marginal edge 26 through which threads may be sewn to fasten the second elements 11, 41 to the parts 24, 27. The first elements 1, 31 may be varied in the same manner as for the second elements, respectively. FIG. 6(*a*) and FIG. 6(*b*) show the variation of the second element shown in FIG. 1, wherein the marginal edge 26 is modified as shown, and FIG. 7(*a*) and FIG. 7(*b*) show the variation of the second element shown in FIG. 2, wherein the marginal edge 26 is modified as shown.

For each of the first and second elements, all of the metallic component parts including the annular permanent magnet, ferromagnetic disk-like plate and ferromagnetic projecting member may be covered with the covering 21, 22 that may be made of any suitable synthetic resin film or sheet, and the exposed portion of the covering may be closed by fusion or bonding.

Alternatively, all of the metallic component parts including the annular permanent magnet, ferromagnetic disk-like plate and ferromagnetic projecting member may be enclosed within the synthetic resin cylindrical casing, which is open on one side (the top, for example) and closed on the other side (the bottom, for example). Within the cylindrical casing, the permanent magnet 2, 12 may be disposed with its non-attracting side on the open side, and the ferromagnetic disk-like plate 4, 14 may be disposed in such a way that it can engage the non-attracting side of the permanent magnet 2, 12 by inserting the ferromagnetic projecting member 5, 15 through the center bore 3, 13 from the top open side of the casing. In this case, the cylindrical casing may have an inner diameter equal to the outer diameter of the annular permanent magnet 2, 12 and ferromagnetic disk-like plate 4, 14, and may have an inner height equal to the sum of the thickness of the permanent magnet 2, 12 plus the thickness of the disk-like plate 4, 14, respectively. The top open side of the casing may be covered with any suitable synthetic resin film or sheet, and may be closed by fusion or bonding.

According to the magnetic lock device as described above, when the first element 1 and the second element 11 may attract each other magnetically as shown in FIG. 1(*b*), the respective coverings 21 and 22, are present between the ferromagnetic projecting members 5 and 15. As described, however, the first element 1 and the second element 11 contain the respective annular permanent magnets 2 and 12 that are disposed to provide the opposed polarities on the respective sides 9 and 19 of the first and second elements 1 and 11 that are to engage each other. In the example shown in FIG. 1, the polarity on the side 9 is assumed to be S while the polarity on the side 19 is assumed to be N. This may be reversed. As shown in FIG. 1, the first and second elements 1 and 11 may attract each other, as shown by arrows 52*a*, 52*b*, under the magnetic interaction of the permanent magnets 2 and 12 that produce the magnetic lines of force that, beginning with the permanent magnet 2, pass through the first ferromagnetic disk-like plate 4, the first ferromagnetic projecting member 5 and then through the second ferromagnetic projecting member 15, the second ferromagnetic disk-like plate 14, finally reaching the permanent magnet 12. The magnetic circuit thus generated is coupled with the magnetic interaction between the permanent magnets 2 and 12, as shown by the arrows 52*a*, 52*b*, thereby increasing the magnetic force that can keep the first and second elements 1 and 11 coupled securely. Thus, the first and second elements 1 and 2 cannot slide laterally relative to each other, as shown by arrows 29, 30 in FIG. 1(*b*), when an attempt is made to slide them laterally relative to each other.

The magnetic interaction between the permanent magnets 2 and 12 as shown by arrows 52*a*, 52*b*, coupled with the magnetic lines of force through the first and second ferromagnetic projecting members 5 and 15, enables the first and second projecting members 5, 15 to be aligned with each other. Thus, the first and second elements 1 and 11 can accurately face each other, and can then be coupled.

The first and second annular permanent magnets 2 and 12 that can be utilized for the purpose of the present invention may include Nd—Fe—B group sintered magnets, rare earth magnets such as neodymium group bond magnets, or even any other conventional ferrite magnets that provide a powerful magnetic force. By using those magnets, powerful magnets may be obtained although they are compact and thin.

For the magnetic lock device according to the present invention, for example, the first and second annular permanent magnets 2, 12 may have a diameter of between 10 mm and 20 mm and the thickness of between 0.5 mm and 2.0 mm, the center bores 3, 13 for the permanent magnets may have a diameter of between 5 mm and 10 mm, the first and second ferromagnetic projecting members 5, 15 may have a maximum diameter of between 5 mm and 10 mm, and the synthetic resin coverings 21, 22 may have a thickness of between 0.05 mm and 0.5 mm.

When the magnetic lock device is specifically designed for use with bags or clothes, the specific values that are given above for each of the individual component parts including the permanent magnet, etc. may be chosen so that the before described appropriate dimensional relationship among the individual component parts can be maintained, by considering the total size of the first or second element.

The first and second ferromagnetic disk-like plates 4, 14 and the first and second ferromagnetic projecting members 5, 15 may be formed from iron, for example.

The magnetic lock device that has been described so far may be modified as shown in FIG. 2(*a*), FIG. 2(*b*) and FIG. 2(*c*). Specifically, the first element shown in FIG. 1(*a*), FIG. 1(*b*) and FIG. 1(*c*) may be modified in such a way that the synthetic resin covering 21 has a center bore 50 on the side on which the first element 31 is to engage the second element 41, and the first ferromagnetic projecting member 33 that extends from the center of the first ferromagnetic disk-like plate 4 and through the center bore 3 in the first annular permanent magnet 2 has the length sufficient to permit it to extend further through the center bore 50 on the covering 21 by making intimate contact with the inner wall of the center bore 50 until it reaches the side 44 of the covering 21, while the synthetic resin covering 22 has a center bore 51 on the side on which the second element 41 is to engage the first element 31, and the second ferromagnetic projecting member 35 that extends from the center of the second ferromagnetic disk-like plate 14 and through the center bore 13 in the second annular permanent magnet 12 has the length sufficient to permit it to extend further through the center bore 51 on the covering 22 by making intimate contact with the inner wall of the center bore 51 until it reaches the side 45 of the covering 22. For the first and second elements 31 and 41, all of the individual component parts are covered with any suitable non-magnetic, synthetic resin film, sheet, covering or casing, or have a coating of any suitable non-magnetic, synthetic resin layer, except for the ends of the first and second projecting members 33, 35 engaging each other that remain uncovered or exposed. Otherwise, the magnetic lock device shown in FIG. 2(*a*), FIG. 2(*b*) and FIG. 2(*c*) is similar to that shown in FIG. 1(*a*), FIG. 1(*b*) and FIG. 1(*c*).

Similarly to the magnetic lock device shown in FIG. 1(*a*), FIG. 1(*b*) and FIG. 1(*c*), the gap or space that is present between the outer peripheral wall of the first ferromagnetic projecting member 33 and the inner peripheral wall of the center bore 3 in the annular permanent magnet 2 may be shielded from the outside by the side 44 of the covering 21 engaging the covering 22, and the gap or space that is present between the outer peripheral wall of the second ferromagnetic projecting member 35 and the inner peripheral wall of the center bore 13 in the annular permanent magnet 12 may be shielded from the outside by the side 45 of the covering 22 engaging the covering 21. Thus, for each of the first and second elements, any foreign matter such as dust, particularly magnetic particles like iron, cannot enter the gap or space from the outside.

In the embodiment shown in FIG. 2(*a*), FIG. 2(*b*) and FIG. 2(*c*), the ends of the first ferromagnetic projecting member 33 and second ferromagnetic projecting member 35 that arc to engage each other when the first element 1 and the second element 11 are actually coupled together remain uncovered, and may make contact with each other directly but not through the respective non-magnetic, synthetic resin coverings 21 and 22, and the magnetic circuit formed by the first and second ferromagnetic projecting members, the first and second ferromagnetic plates, and the first and second annular permanent magnets may produce a more powerful magnetic force. Thus, when the first element 31 and the second element 41 are coupled, they will never slide laterally relative to each other as shown by arrows 29, 30 in FIG. 2(*b*) when any external sliding force is applied. In addition, as the first and second ferromagnetic projecting members 33 and 35 can be aligned with each other correctly when the first and second elements 31 and 41 are to be coupled by attracting each other magnetically, the first and second elements 31 and 41 can be coupled securely.

In the embodiment shown in FIG. 2(*a*), FIG. 2(*b*) and FIG. 2(*c*), it is possible that any foreign matter such as iron particles may be attached to the ends of the first and second ferromagnetic projecting members 33 and 35 that are to engage each other, because those ends remain uncovered or are exposed to the outside as described above. If this should occur, however, those iron particles may easily be removed from the ends by gently wiping them off. As the gap or space between the inner peripheral wall of the center bore in the permanent magnet and the outer peripheral wall of the ferromagnetic projecting member for each of the first and second elements is protected against any foreign matter or iron particles, the magnetic force from the magnetic circuit will never be weakened.

As described later, the ends of the first and second ferromagnetic projecting members 33 and 35 that are to engage each other may have a coating of any nonmagnetic material that protects those ends against any possible rust that may gather thereon.

It may be appreciated from the foregoing description that the principal object of the present invention is to protect the gap or space between the inner peripheral wall of the center bore in the annular permanent magnet and the outer peripheral wall of the ferromagnetic projecting member against the entry of the iron particles or other foreign matter such as dust, or to cover the portions of the metal component parts that are exposed to the outside in order to prevent any rust gathering there. For this purpose, each of the individual metal component parts, including the first ferromagnetic projecting member 5, 33, second ferromagnetic projecting member 15, 35, first and second annular permanent magnets 2, 12, and first and second ferromagnetic disk-like plates 4, 14, or the exposed portions of the respective metal component parts as assembled in the first and second elements, or the whole first and second elements incorporating the respective metal component parts as assembled, may be covered by applying a coating or spray coating of nonmagnetic materials such as polyamide, epoxy resin or by the electro-deposition process. The gap or space that is present between the inner peripheral wall of the center bore in the annular permanent magnet and the outer peripheral wall of the ferromagnetic projecting member may be filled with the same materials as the above coating materials (not shown), and the respective sides of the first elements 1, 31 and the second elements 11, 41 on which the first and second elements are to be fastened to an article 24, 27 such as clothes, respectively, may be covered with any synthetic resin sheet or film forming the marginal edge 23, 26 by attaching it to the respective sides by means of bonding.

Figure 3:
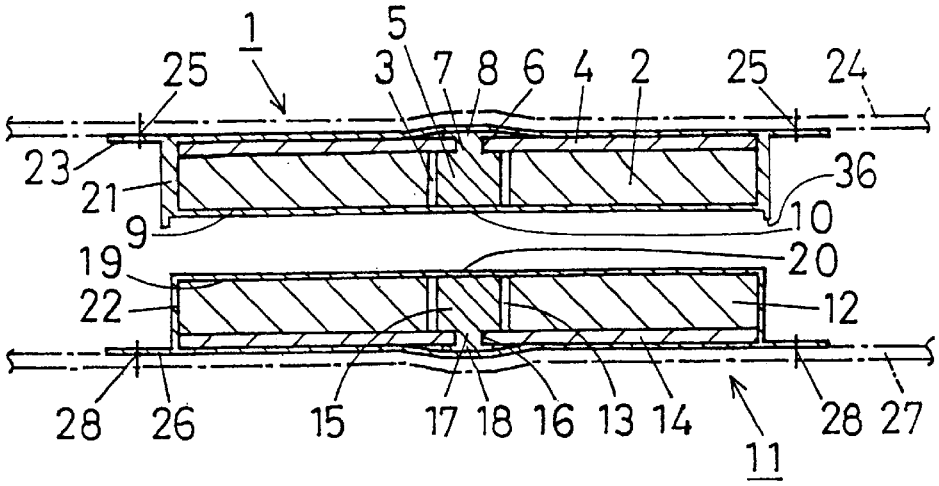
FIG. 3(*a*), FIG. 3(*b*), FIG. 3(*c*) and FIG. 3(*d*) illustrate a third preferred embodiment of the present invention, in which FIG. 3(*a*) is a cross sectional view of first and second elements that arc separated from each other, FIG. 3(*b*) is a cross sectional view of the first and second elements that are coupled, FIG. 3(*c*) is a plan view of the second element, and FIG. 3(*d*) is a plan view of the first element.
Figure 3:
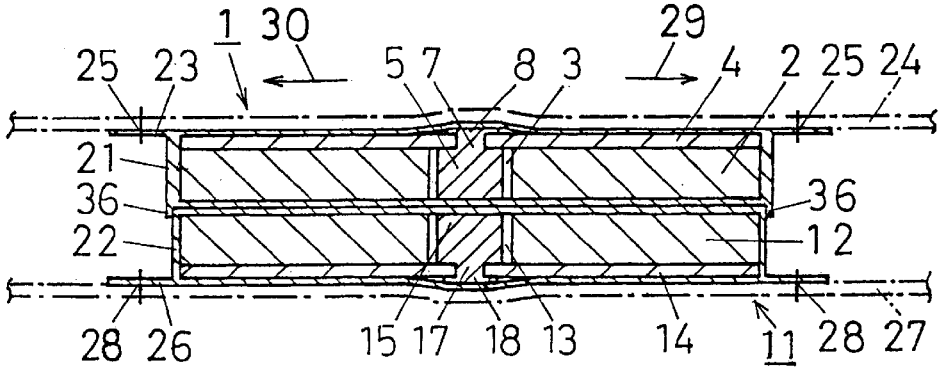
Figure 3:
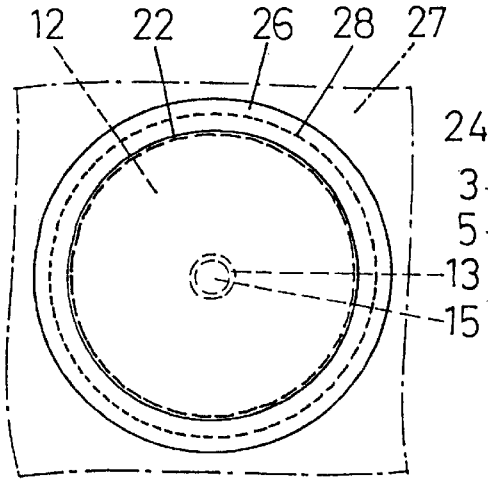
Figure 3:
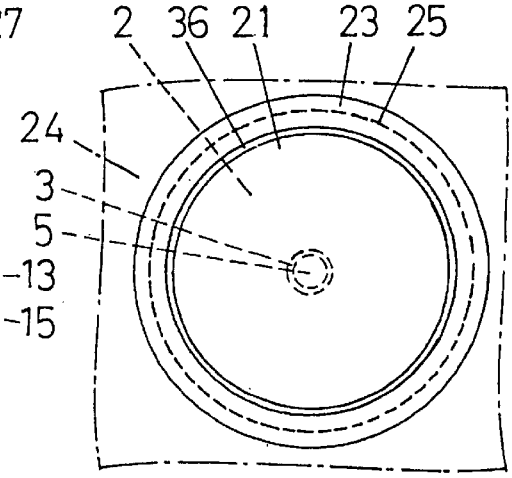
Figure 4:
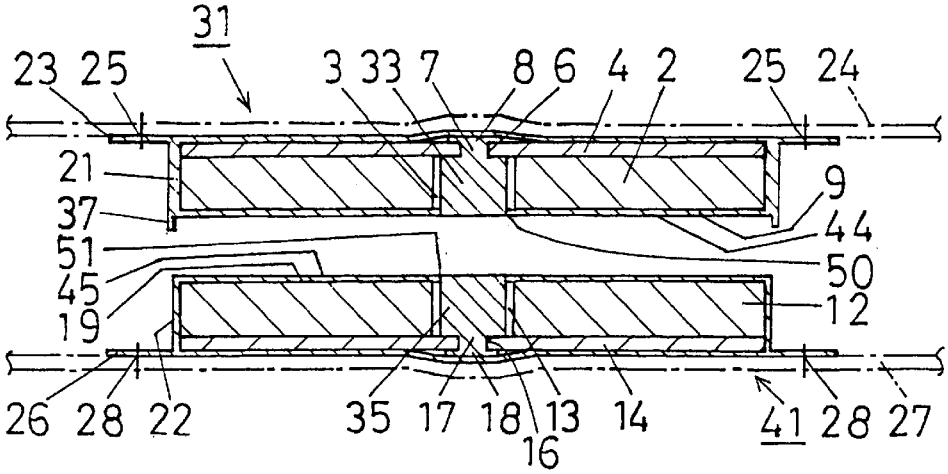
FIG. 4(*a*), FIG. 4(*b*), FIG. 4(*c*) and FIG. 4(*d*) illustrate a fourth preferred embodiment of the present invention, in which FIG. 4(*a*) is a cross sectional view of first and second elements that are separated from each other, FIG. 4(*b*) is a cross sectional view of the first and second elements that are coupled, FIG. 4(*c*) is a plan view of the second element, and FIG. 4(*d*) is a plan view of the first element.
Figure 4:
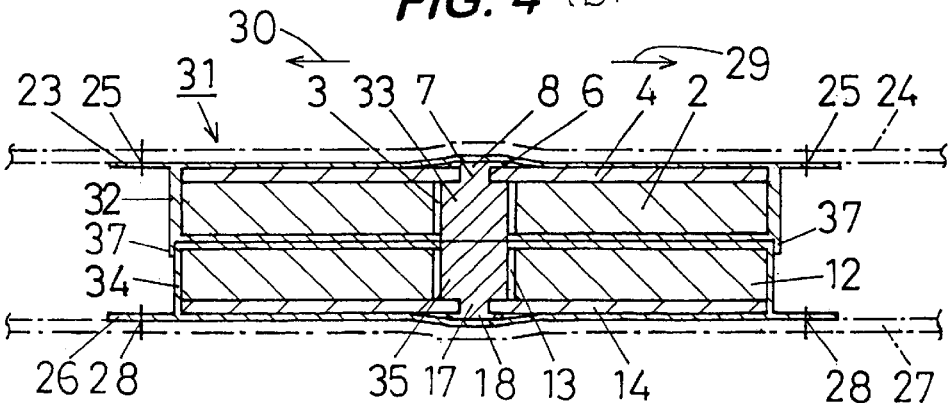
Figure 4:
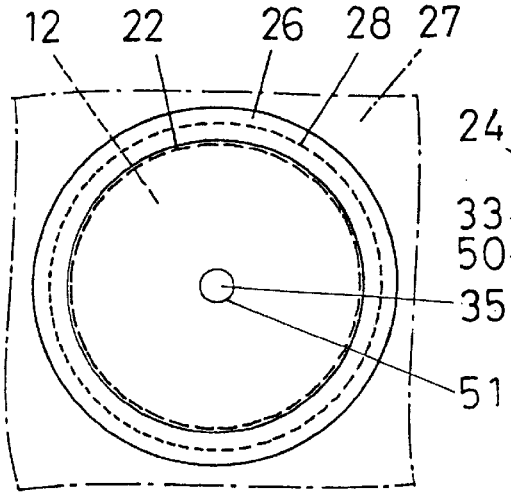
Figure 4:
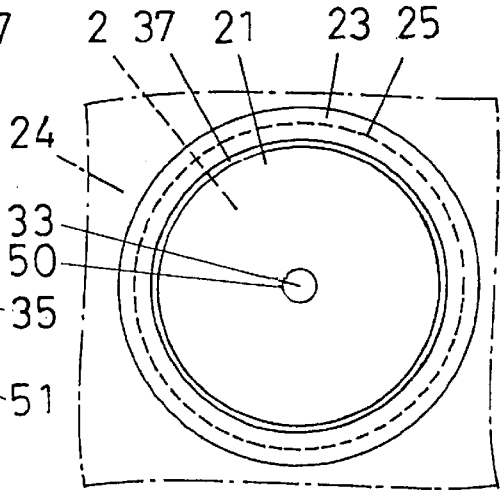

The magnetic lock devices shown in FIGS. 1(*a*), FIG. 1(*b*) and FIG. 1(*c*) and FIG. 2(*a*), FIG. 2(*b*) and FIG. 2(*c*) may be modified as shown in FIGS. 3(*a*) to FIG. 3(*d*) and FIG. 4(*a*) to FIG. 4(*d*), respectively.

Specifically, as shown in FIG. 3(*a*) to FIG. 3(*d*), the first element 1 shown in FIG. 1(*a*), FIG. 1(*b*) and FIG. 1(*c*) may be modified such that the synthetic resin covering 21 is equipped with an annular rising flange 36 around the peripheral edge thereof on the side 10 on which the first element 1 is to engage the second element 11 so that the annular rising flange 36 can accept the peripheral edge of the second element 11 on the side 20 on which the first element 1 is to engage the second element 11, when they have actually engaged each other. Similarly, as shown in FIG. 4(*a*) to FIG. 4(*d*), the first element 31 shown in FIG. 2(*a*) to FIG. 2(*c*) may be modified such that the synthetic resin covering 32 is equipped with an annular rising flange 37 around the peripheral edge thereof on the side 44 on which the first element 31 is to engage the second element 41 so that the annular rising flange 37 can accept the peripheral edge of the second element 41 on the side 45 on which the first element 31 is to engage the second element 41, when they have actually engaged each other.

According to the magnetic lock devices of FIG. 1(*a*) to FIG. 1(*c*) and FIG. 2(*a*) to FIG. 2(*c*) including the first element as modified as shown in FIGS. 3(*a*) to FIG. 3(*d*) and 4(*a*) to FIG. 4(*d*), respectively, the respective annular rising flange 36, 37 on the first element 1 can accept the second element 11 when they have actually engaged each other, and can prevent them from sliding laterally relative to each other, as shown by arrows 29, 30 in FIG. 3(*b*) and FIG. 4(*b*), respectively. The first and second elements can thus be coupled in their proper positions.

It should be noted that the annular rising flanges 36 and 37 shown in FIGS. 3(*a*) to FIG. 3(*d*) and 4(*a*) to FIG. 4(*d*) do not have to be provided around the total peripheral edge of the respective synthetic resin coverings 21, 32. Instead, the flanges 36, 37 may be provided on half the peripheral edge of the respective coverings 21, 32. In this way, the first and second elements can be disengaged easily when they are engaged.

Figure 5:
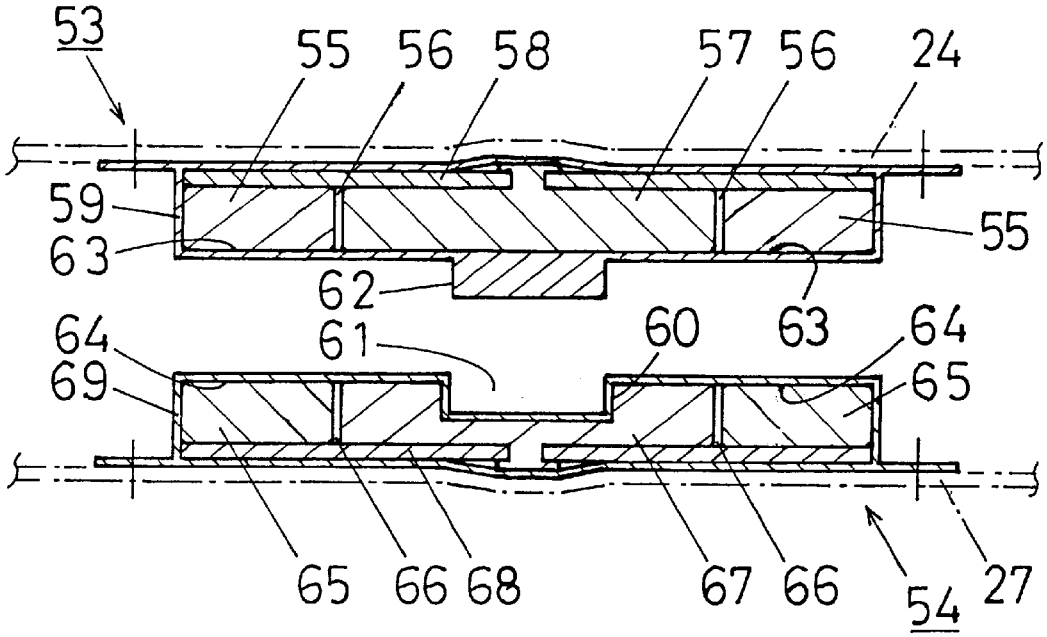
FIG. 5 illustrates a fifth preferred embodiment of the present invention, showing the cross section of first and second elements that are separated from each other.

The present invention may be modified in other different manners. FIG. 5 represents one example of those possible modifications.

The magnetic lock device shown in FIG. 5 is essentially the same as that shown in FIG. 1(*a*) to FIG. 1(*c*), except that the second ferromagnetic projecting member 67 on the second element 54 has a larger diameter, and has a center recess 60 while the synthetic resin covering 59 on the first element 53 has a boss 62 on the center that engages the recess 60 on the second element 54 when the first and second elements engage each other.

Specifically, for the magnetic lock device shown in FIG. 5, the first element 53 includes a first annular permanent magnet 55 having a center bore 56 through it, a first ferromagnetic disk-like plate 58 in contact with the non-attracting side of the first annular permanent magnet 55, and a first ferromagnetic projecting member 57 extending from the center of the first ferromagnetic disk-like plate 58 and through the center bore 56 in the first annular permanent magnet 55 until it reaches the plane flush with the plane of the attracting side 63 of the first annular permanent magnet 55 opposite the non-attracting side, all of which are packaged as a single unit within a synthetic resin covering 59.

On the other hand, the second element 54 includes a second annular permanent magnet 65 having a center bore 66 and disposed to provide a polarity opposed to that of the first annular permanent magnet 55 on the attracting side 64 on which the second element 54 engages the first element 53, a second ferromagnetic disk-like plate 68 in contact with the non-attracting side of the second annular permanent magnet 65 opposite the attracting side 64, and a second ferromagnetic projecting member 67 extending from the second ferromagnetic disk-like plate 68 and through the center bore 66 in the second annular permanent magnet 65 until it reaches the plane flush with the plane on the attracting side 64 of the second annular permanent magnet 65, all of which are packaged as a single unit within a synthetic resin covering 69.

As shown in FIG. 5, the second ferromagnetic projecting member 67 has a recess 60 at the center, and the synthetic resin covering 69 that covers the entire second element 54 is also formed to have a recess at the center to conform with the recess 60. Thus, the second element 54 has a recess 61 at the center. On the other hand, the synthetic resin covering 59 that covers the entire first element 53 has a projection 62 at the center on the side on which the first element 53 is to engage the second element 54. The projection 62 can engage the recess 61 when the first and second elements 53 and 54 engage each other.

When an attempt is made to couple the first element 53 and the second element 54 together, the respective annular permanent magnets 55 and 65 in the first and second elements, which provide the opposite polarities facing each other, will magnetically attract each other, while at the same time, a magnetic circuit is concluded which, starting at the upper part of the first annular permanent magnet 55, passes through the first ferromagnetic disk-like plate 58 to the first ferromagnetic projecting member 57 and then through the second ferromagnetic projecting member 67 to the second ferromagnetic disk-like plate 68 until finally it reaches the lower part of the second annular permanent magnet 65. The magnetic attraction between the first and second magnets, coupled with the magnetic attraction provided by the magnetic circuit as well as the recess 61 and projection 62 engaging each other, will make the first and second elements 53 and 54 coupled more securely, without sliding laterally relative to each other.

Figure 8:
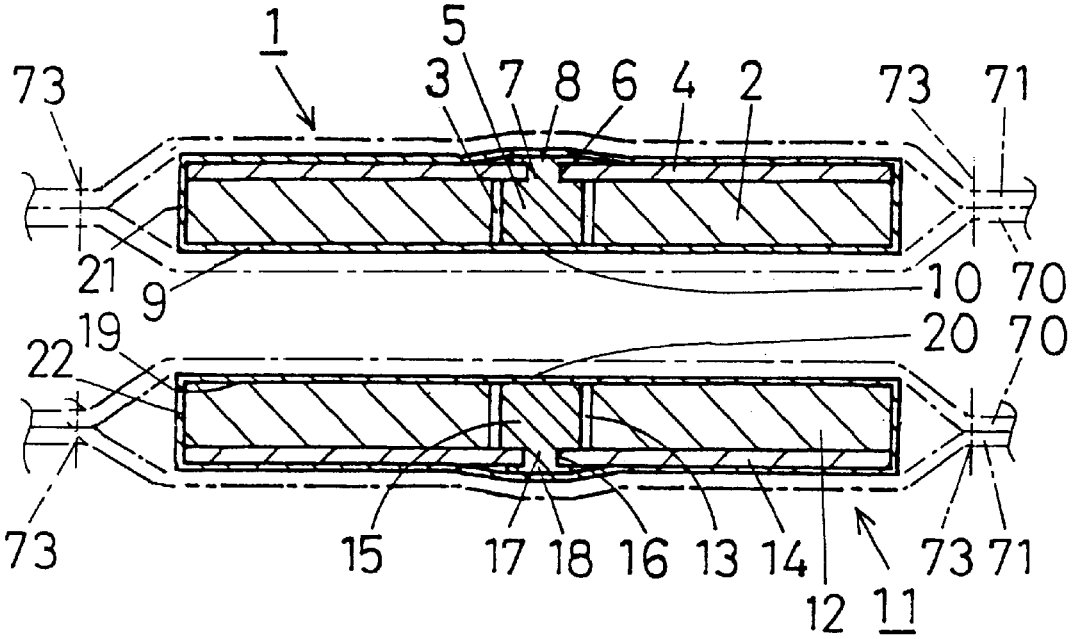
FIG. 8 illustrates an eighth preferred embodiment of the present invention, showing the cross section of first and second elements that are separated from each other.

FIG. 8 represents another embodiment of the magnetic lock device. The magnetic lock device shown in FIG. 8 is specifically designed for use with clothes. It includes a first element and a second element, both of which may be mounted between the front side cloth 70 and back side cloth 71, and may be sewn by threads 73 into the front side cloth 70 and back side cloth 71, keeping the first and second elements aligned. The magnetic lock device shown in FIG. 8 is essentially the same as that shown in FIG. 1(*a*) to FIG. 1(*c*), except that there are no such annular marginal edges 23, 26 as found on the magnetic lock device of FIG. 1(*a*) to FIG. 1(*c*). In the embodiment shown in FIG. 8, the first and second elements may be mounted between the front side cloth 70 and back side cloth 71, and may be sewn by threads 73 into the front side cloth and back side cloth, without having to rely on the marginal edges 23, 26. The first and second elements, which are embedded between the front side cloth and back side cloth, maybe coupled together in a secure manner, by permitting the annular permanent magnets 2 and 12 of opposite polarities facing each other to attract each other.

Although the present invention has been described with reference to several particular preferred embodiments thereof, it should be understood that various changes and modifications may be made without departing from the spirit and scope of the invention as defined in the appended claims.

What is claimed is:

1. A magnetic lock device comprising a first element and a second element that are capable of being detachably coupled together by the magnetic interaction thereof, wherein said first element includes:

a first annular permanent magnet having a center bore through it;

a first ferromagnetic disk-like plate disposed to make contact with the non-attracting side of said first annular permanent magnet;

a first ferromagnetic projecting member extending from the center of said first ferromagnetic disk-like plate and through said center bore in said first annular permanent magnet until it reaches the plane flush with the plane of the attracting side of said first annular permanent magnet opposite said non-attracting side; and said first annular permanent magnet, said first ferromagnetic disk-like plate and said first ferromagnetic projecting member being covered with non-magnetic, synthetic resin covering; and said second element includes:

a second annular permanent magnet having a center bore through it and providing a polarity on the attracting side thereof that is opposed to the polarity of said first annular permanent magnet on said attracting side thereof, for attracting each other magnetically;

a second ferromagnetic disk-like plate disposed to make contact with the non-attracting side of said second annular permanent magnet;

a second ferromagnetic projecting member extending from the center of said second ferromagnetic disk-like plate and through said center bore in said second annular permanent magnet until it reaches the plane flush with the plane of said attracting side of said second annular permanent magnet opposite said non-attracting side; and said second annular permanent magnet, said second ferromagnetic disk-like plate and said second ferromagnetic projecting member being covered with non-magnetic, synthetic resin covering.

2. The magnetic lock device as defined in claim 1, wherein for said first element, said synthetic resin covering has a center bore on the side on which said covering is to engage said second element, and said first ferromagnetic projecting member extending from the center of said first ferromagnetic disk-like plate and through said center bore in said first annular permanent magnet is of such a length that it extends further through said center bore of said synthetic resin covering, with its outer wall being in intimate contact with the inner wall of said center bore until it reaches the plane flush with the plane on the side of said synthetic resin covering, and for said second element, said synthetic resin covering has a center bore on the side on which said covering is to engage said first element, and said second ferromagnetic projecting member extending from the center of said second ferromagnetic disk-like plate and through said center bore in said second annular permanent magnet is of such a length that it extends further through said center bore of said synthetic resin covering, with its outer wall being in intimate contact with the inner wall of said center bore until it reaches the plane flush with the plane on the side of said synthetic resin covering.

* * * * *